US005862754A

United States Patent [19]

Hill et al.

[11] Patent Number: 5,862,754

[45] Date of Patent: Jan. 26, 1999

[54] INSERTER MODULE ADAPTABLE FOR USE WITH BOTH PREPRINTED AND IN-LINE PRINTED CARRIERS AND METHOD

[75] Inventors: Jeffery L. Hill, Mundelein; Gregory S. Hill, Lake Zurich, both of Ill.

[73] Assignee: Dynetics Engineering Corporation, Lincolnshire, Ill.

[21] Appl. No.: 859,685

[22] Filed: May 20, 1997

Related U.S. Application Data

[63] Continuation-in-part of Ser. No. 521,350, Aug. 29, 1995.

[51] Int. Cl.[6] ..... B91F 13/54

[52] U.S. Cl. ..... 101/228; 400/613; 400/621; 270/101; 270/58.06; 225/100

[58] Field of Search ..... 101/219, 228, 101/226; 400/578, 611, 613.2, 613.1, 613.3, 621, 624; 270/1.01, 58.06, 32; 225/100, 106, 96; 226/100, 24; 83/74; 235/375

[56] References Cited

U.S. PATENT DOCUMENTS

| | | | |
|---|---|---|---|
| 5,003,485 | 3/1991 | Francisco | 270/58.06 |
| 5,266,781 | 11/1993 | Warwick et al. | 235/375 |
| 5,270,938 | 12/1993 | Sansone et al. | 364/464.02 |
| 5,388,815 | 2/1995 | Hill et al. | 270/32 |
| 5,433,364 | 7/1995 | Hill et al. | 225/96 |
| 5,494,544 | 2/1996 | Hill et al. | 156/64 |
| 5,509,886 | 4/1996 | Hill et al. | 493/419 |
| 5,768,959 | 6/1998 | Lorenzo | 83/74 |

*Primary Examiner*—Christopher A. Bennett
*Attorney, Agent, or Firm*—Potthast & Associates

[57] ABSTRACT

A card insertion system (10) and method in which a free standing inserter module (12) for inserting cards into carriers has a carrier inlet (14) at a preselected elevation (14') for selectively, alternatively interfacing with, and receiving carrier forms (15) from, a free standing in-line carrier form printer module (20) with a carrier form outlet (22) at the preselected elevation (22') to feed in-line carrier forms to the printer inlet when the burster module (32) and printer module (20) are positioned in relative cooperate adjacent alignment and in which a free standing burster (32) for separating preprinted continuous carrier form stock into bursted separate carriers with a bursted carrier form outlet (38) at a preselected elevation (38') substantially the same as that of the carrier inlet (14) of the inserter (12) to enable direct insertion of the preprinted forms ejected from the burster outlet (38) into the carrier inlet (14) of the inserter module (12) when the inserter module (12) and printer module (20) are positioned in relative cooperative adjacent alignment.

8 Claims, 3 Drawing Sheets

INSERTER MODULE ADAPTABLE FOR USE WITH BOTH PREPRINTED AND IN-LINE PRINTED CARRIERS AND METHOD

CROSS REFERENCE TO RELATED APPLICATION

This application is a continuation-in-part of U.S. patent application Ser. No. 08/521,350 filed Aug. 29, 1995 of Hill et al. entitled "Printing Assembly With Discrete Sheet Load Enhancement Apparatus and Method" which is hereby incorporated by reference.

BACKGROUND OF THE INVENTION

1. Field of the Invention

This invention generally relates to card insertion systems and, more particularly, to modular apparatus and methods for making and using such insertion systems.

2. Description of the related art including information disclosed under 37 C.F.R. 1.97–1.99

Card insertion systems which function to automatically insert one or more credit cards into matching carrier forms are well known.

A disadvantage of known insertion systems is their lack of versatility with respect to printing of the carrier forms. In some systems, the inserters are capable of working only in conjunction with preprinted carrier forms that are fed in continuous fan-folded form to a burster comprising part of the system which is operated to separate the preprinted forms into separated discrete carrier forms which, in turn, are fed seriatim to the inserter one at a time for receipt of inserted cards. These preprinted form systems are not capable of operating in conjunction with in-line carrier form printers.

In other insertion systems, the inserters are contained in a single cabinet with an in-line printer and other apparatus to form a complete card package production system. These card package production systems are not compatible for use with single sheet preprinted carrier forms and operate only with continuous forms.

SUMMARY OF THE INVENTION

It is therefore the principal object of the present invention to overcome the disadvantageous lack of versatility of known card insertion systems by providing modular apparatus and methods of making and using an insertion system in which both preprinted carrier forms and in-line printed carrier forms are capable of being used.

Accordingly, it is an object of the present invention to provide a modular insertion system with a free standing inserter module for inserting cards into matching carrier forms including a carrier inlet for receiving separate carrier forms located at a preselected elevation, a free standing printer module for printing carrier forms with a carrier form outlet located at a preselected elevation substantially the same as that of the carrier inlet of the inserter module to enable direct insertion of printed forms ejected from the printer outlet into the carrier inlet of the inserter when the inserter module and printer module are positioned in relative cooperative adjacent alignment, and a free standing burster for separating preprinted continuous carrier form stock into bursted separate carriers with a bursted carrier form outlet at a preselected elevation substantially the same as that of the carrier inlet of the inserter to enable direct insertion of the preprinted forms ejected from the burster outlet into the carrier inlet of the inserter module when the inserter module and printer module are positioned in relative cooperative adjacent alignment.

Also, the object of the invention is obtained by provision of a method of making a card insertion system, comprising the steps of (1) interfacing an inserter module with a printer to enable printing of blank carrier forms on an on-line basis immediately prior to provision of the carrier forms to the inserter and (2) alternatively, interfacing the inserter module directly with a burster to enable provision of off-line preprinted carrier forms to the inserter module at a rate relatively more rapid than at which the printer can print carrier forms on-line.

BRIEF DESCRIPTION OF THE DRAWINGS

The foregoing objects and advantageous features of the invention will be explained in greater detail and others will be made apparent from the detailed description of the preferred embodiment of the present invention which is given with reference to the several figures of the drawing, in which.

DESCRIPTION OF THE PREFERRED EMBODIMENT

Figure 1A:
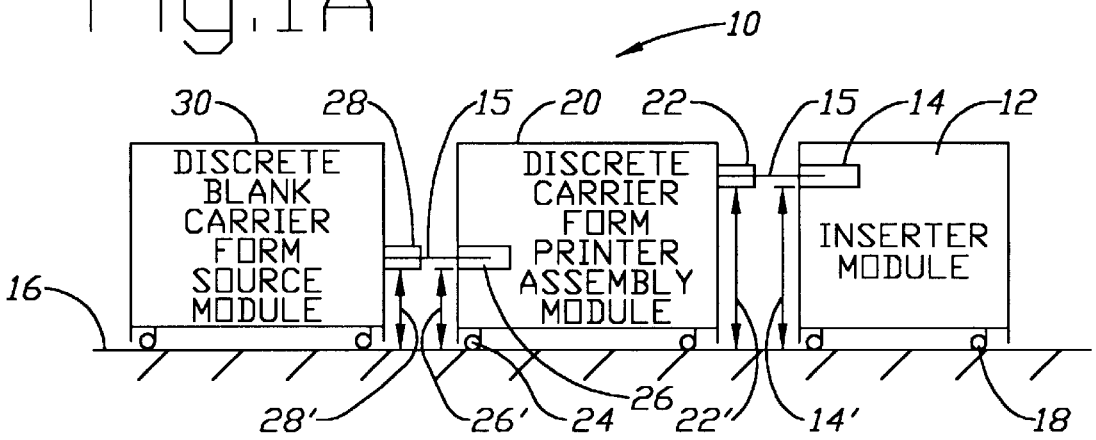
FIG. 1A is a schematic illustration of a preferred embodiment of the modular card insertion system of the present invention in which carrier forms are printed in line.
Figure 1B:
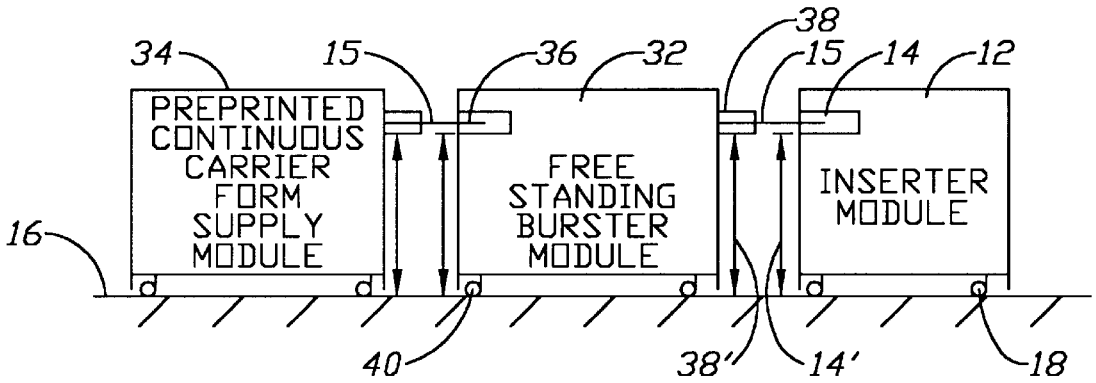
FIG. 1B is a schematic illustration of the modular card insertion system of the present invention in which preprinted continuous carrier forms are fed to the inserter module.

The preferred embodiment of the modular card insertion system 10 of the present invention is collectively shown in both FIGS. 1A and 1B. In FIG. 1A the modular card insertion system 10 is configured for on-line printing of the carrier forms and includes a free standing inserter module 12 for inserting cards into matching carrier forms. It includes a carrier inlet 14 for receiving separate carrier forms into which the cards are to be inserted. The carrier inlet 14 is located at a preselected elevation 14' above a underlying floor surface 16 upon which the inserter 12 is supported, preferably on wheels 18, or other means for facilitating translational movement across the floor 16 such as glides or casters with levelers. Adjacent to the inserter 12 is a free standing discrete carrier form printer module 20 for printing carrier forms 15. The discrete carrier form printer module 20 has a carrier form outlet 22 located at a preselected elevation 22' above the floor 16 which is substantially the same as elevation 14' of the carrier inlet 14 of the inserter module 12. The discrete form printer module 20, like the inserter module 12, is preferably mounted on wheels 24 or the like to facilitate movement into cooperative alignment with the inserter module 12 as shown in FIG. 1A. When aligned with levelers for wheels 24, as shown in FIG. 1A, a carrier from the discrete carrier form printer module is enabled to pass directly from the carrier outlet 22 into the carrier 22 of the discrete carrier form printer module 20 directly into the inlet 14 of the inserter module 12.

The discrete carrier form printer module 20 has an inlet 26 located at a preselected elevation 26' above the floor surface 16. The inlet 26 receives carriers 15 from an outlet 28 of a discrete blank carrier form source module 30. The outlet 28 is located at a preselected elevation 28' which is substantially identical to preselected elevation 26' of the printer module inlet 26. When the discrete blank carrier form source module is properly positioned in relative cooperative adjacent alignment as shown in FIG. 1A, carrier forms 15 from outlet 28 are enabled to be inserted directly into the inlet 26.

Referring now to FIG. 1B, the modular card insertion system 10 of the present invention is also seen to include in an alternative configuration to that of FIG. 1A a free standing burster 32 which functions to burst, or separate, carrier forms 15 from a preprinted continuous carrier form supply module 34 into to individual separate carrier forms. Pin hole strips on the continuous forms supply are also removed. In the preferred embodiment, the preprinted continuous carrier form supply module 34 consists of a stack of fan-folded interconnected carrier forms. These are fed to the inlet 36 of the free standing burster module. The free standing burster module 32 then separates these carriers and outputs separate discrete carriers 15 at its carrier outlet 38.

The carrier outlet 38 is at a preselected elevation 38' which is substantially identical to the preselected elevation 14' and thus also substantially equal to the preselected elevation 22' of the outlet 22 of the discrete carrier form printer module 20. The free standing burster module also is mounted on wheels 40 or other means for facilitating translational movement across the floor 16 which includes a leveler. When the free standing burster module 32 and the inserter module 12 are positioned in relative cooperative adjacent alignment as shown in FIG. 1B, the free standing burster module 32 is enabled to directly insert discrete carrier forms 15 into the carrier inlet 14 of inserter module 12 in lieu of the discrete carrier form printer module doing so. The discrete carrier form printer module, because it is required to print the carrier forms, operates at an approximate speed of 32 printed carrier forms per minute. When it is desired to or needed to print blank carrier forms in line during the insertion process, the discrete carrier form printer module 20 and the discrete blank carrier form source module associated therewith are used in conjunction with the inserter module 12 as shown in FIG. 1A. However, when preprinted continuous carrier forms are available, then the discrete carrier form printer module 20 is moved out of alignment with the inserter 12 and the free standing burster module 32 is moved into alignment. The inserter 12, when operating with the burster 32, operates at a relatively higher rate of approximately forty carriers per minute.

Figure 2:
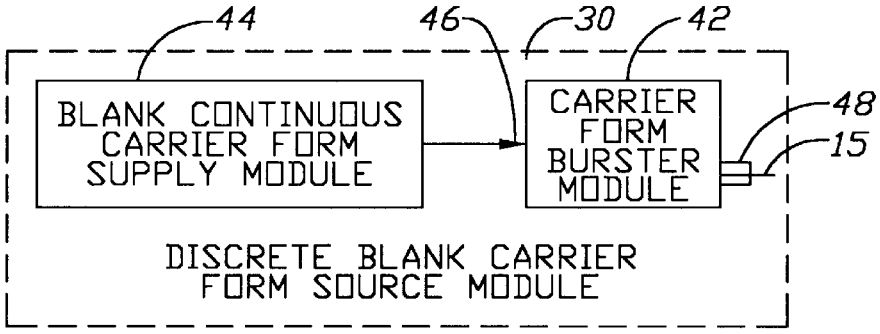
FIG. 2 is a functional block diagram of the discrete blank carrier form source module of FIG. 1A.

Referring to FIG. 2, the discrete blank carrier form source module 30 preferably includes a carrier forms burster 42 which separates blank continuous carrier forms from a blank continuous carrier form supply module 44 which are fed to it at an inlet 46 of the carrier forms burster 42. The carrier forms burster 42 has a carrier outlet 48 corresponding to outlet 28, FIG. 1A, which is at the preselected elevation 28' equal to the preselected elevation 26' of the discrete form carrier form printer module 20 to facilitate direct insertion from the carrier forms burster 42 of carriers 15 into the inlet 26.

Figure 3:
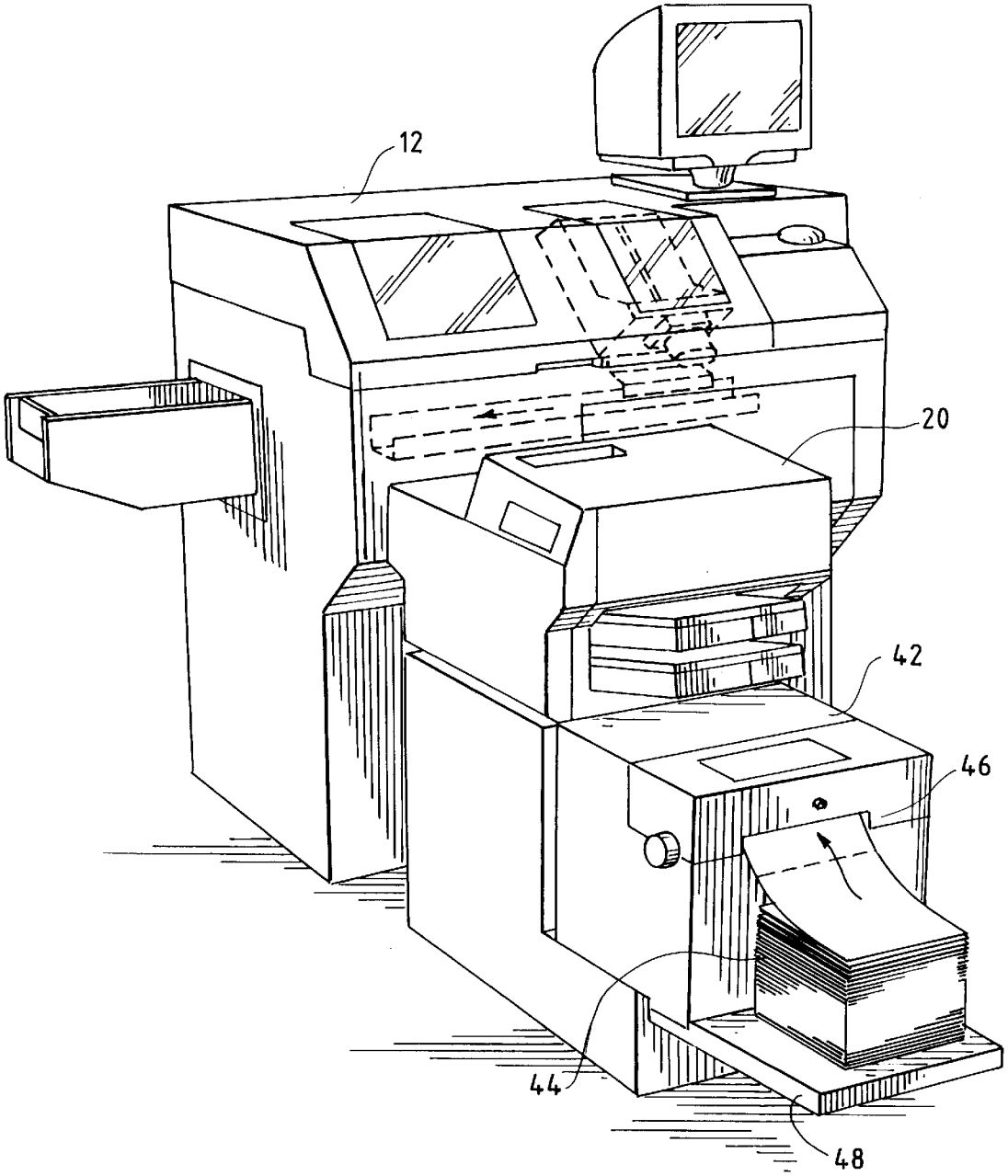
FIG. 3 is a perspective view of a preferred embodiment of the modular insertion inserter system of FIG. 1A.

Referring to FIG. 3 in the preferred embodiment, the inserter module 10 is seen in conjunction with a discrete carrier form printer module 20 to which is releasably mounted a carrier form burster module 42 which includes a shelf 48 on which is carried a supply of blank continuous forms 44 fed to the inlet 46. In turn, the carrier form burster module 42 is removably mounted to a shelf 50 of the carrier form printer 20.

Figure 4A:
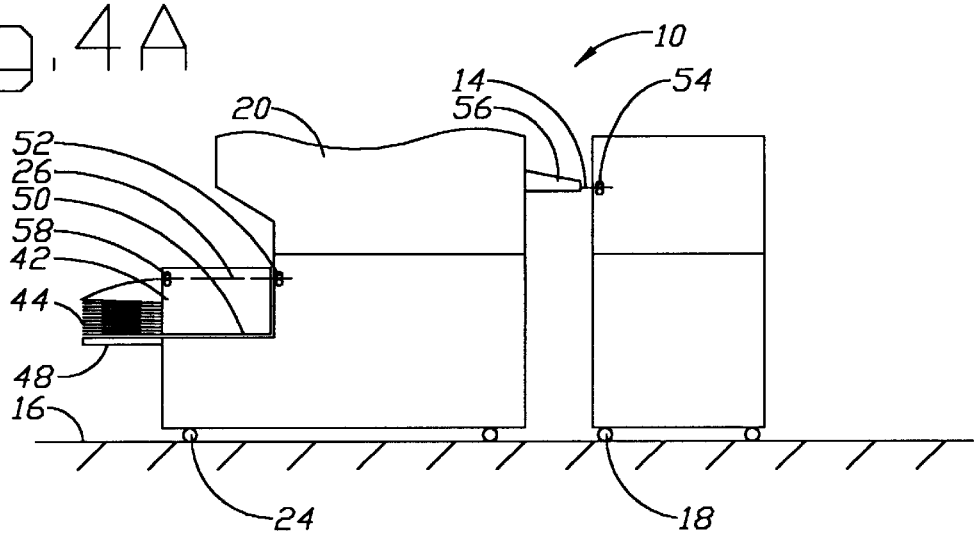
FIG. 4A is a simplified schematic side elevation of the modular insertion system of FIGS. 1A and 3 in which discrete blank carrier forms are obtained from a source of blank continuous carrier form supply and a carrier forms burster as shown in functional block form in FIG. 2.

Referring to FIG. 4A, the modular card insertion system 10 in the configuration illustrated in FIG. 1A and is shown to have the printer module 20 with a pair of pinch rollers 22 at the printer inlet 26 while the inserter module 12 has a pair of pinch rollers 54 at the inlet 14 which receives carriers from a carrier outlet guide 56 of the printer module 20. The burster module 42 also has a pair of pinch rollers 58 at its inlet for receipt of the continuous loosely connected carrier forms 15 of the blank continuous carrier form supply module 44.

Figure 4B:
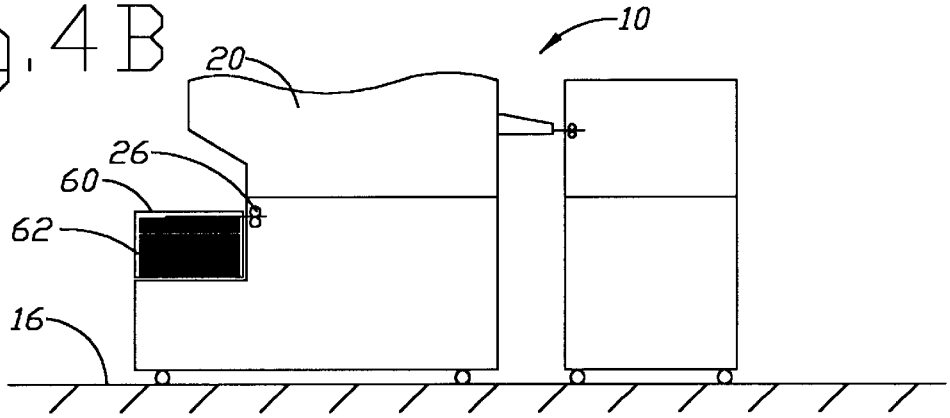
FIG. 4B is a side elevational view of the modular inserter similar to that of FIG. 4A but in which the burster and continuous carrier forms have been replaced with a discrete carrier form supply which is fed to the printer.

Referring to FIG. 4B in lieu of the carrier form burster module 42 being mounted on the shelf 50 of printer 20, the printer is provided with a discrete carrier form module 60 which contains a stack of discrete blank carrier forms 62.

Figure 5:
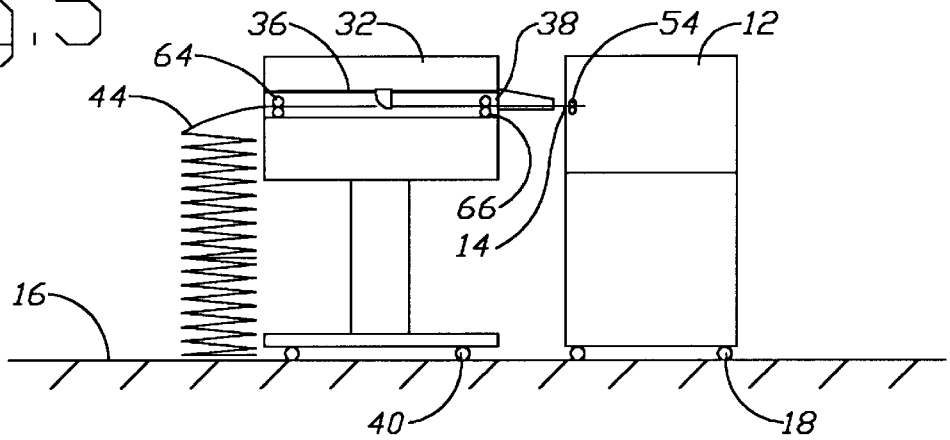
FIG. 5 is a simplified side elevational view of the modular insertion system shown in schematic form in FIG. 1B in which the forms are provided to the inserter from a preprinted continuous carrier form supply which are first passed through a free standing burster to provide individual separated preprinted forms to the inserter module.

Referring now to FIG. 5, the modular card insertion system 10 is schematically illustrated as a side elevational view showing the free standing burster module 32 feeding the inserter module 12 with discrete carrier forms as described above with the configuration shown in FIG. 1B. The blank continuous carrier form supply module 44 contains fan-folded continuous carrier forms which are fed to an inlet of the free standing burster module 32 at its inlet 36 which has a pair of pinch rollers 64 while at the outlet 38 of the free standing burster module 32, another pair of pinch rollers at inlet 14.

It should be appreciated that to the extent the details of the various apparatus referred to or shown herein are not described or shown herein, they form no part of the printed invention. If such details are desired, reference should be made to one or more of U.S. Pat. No. 5,388,815 issued Feb. 14, 1995 to Hill et al. entitled "Embossed Card Package Production System With Modular Inserters For Multiple Forms"; U.S. Pat. No. 5,433,364 issued Jul. 18, 1995 entitled "Card Package Production System With Burster and Carrier Verification Apparatus"; U.S. Pat. No. 5,494,544 issued on Feb. 27, 1996 to Hill et al. entitled "Automatic Verified Embossed Card Package Production Methods"; U.S. Pat. No. 5,509,886 issued Apr. 23, 1996 to Hill et al. entitled "Card Package Production System With Modular Carrier Folding Apparatus For Multiple Forms"; and U.S. Pat. No. 5,541,395 issued Jul. 30, 1996 to Hill et al. entitled "Card Package Production System With Burster and Code Reader". Reference should also be made to U.S. patent application Ser. No. 08/313,548 filed Sep. 23, 1994 (which is a continuation of filewrapper of Ser. No. 08/036,436 filed Mar. 24, 1993) of Hill et al. entitled "Card Carrier Forms For Automated Embossed Card Package Production System"; U.S. provisional patent application Serial No. 08/047,195 (DYN-11) of Hill et al. entitled "Card Inserter With Carrier Folding Apparatus and Method" filed contemporaneously herewith; U.S. provisional patent application Ser. No. 60/047,190 (DYN-12) of Hill et al. entitled "Automatic Card Insertion System With Card Multireader and Method" filed contemporaneously herewith; U.S. patent application Ser.

No. 08/859,295 (DYN-14) of Hill et al. entitled "Printer With Discrete Sheet Load Enhancement Apparatus and Method" filed contemporaneously herewith; and U.S. provisional patent application Ser. No. 60/047,189 (DYN-15) of Hill et al. entitled "Card Package Production System With A Multireader Card Track and Method" filed contemporaneously herewith. All these patents and patent applications are hereby incorporated by reference.

While a detailed description of the preferred embodiment of the invention has been given, it should be appreciated that many variations can be made thereto without departing from the scope of the invention as set forth in the appended claims.

We claim:

1. A card insertion system, comprising:

a free standing inserter module for inserting cards into matching carrier forms including a carrier inlet for receiving separate carrier forms located at a preselected elevation;

a free standing printer module for printing carrier forms with a carrier form outlet located at a preselected elevation substantially the same as that of the carrier inlet of the inserter module to enable direct insertion of printed forms ejected from the printer outlet into the carrier inlet of the inserter when the inserter module and printer module are positioned in relative cooperative adjacent alignment; and a free standing burster for separating preprinted continuous carrier form stock into bursted separate carriers with a bursted carrier form outlet at a preselected elevation substantially the same as that of the carrier inlet of the inserter to enable direct insertion of the preprinted forms ejected from the burster outlet into the carrier inlet of the inserter module when the inserter module and printer module are positioned in relative cooperative adjacent alignment.

2. The card insertion system of claim 1 in which the free standing inserter module includes an inserter, a base for underlying support of the inserter, and means attached to the base for facilitating translational movement of the base across a floor.

3. The card insertion system of claim 2 in which the translational movement facilitating means include rotatable members.

4. The card insertion system of claim 3 in which at least one of the free standing printer module and the free standing burster module includes means for facilitating translational movement across a floor into relative cooperative adjacent alignment.

5. The card insertion system of claim 4 in which both of the free standing printer module and the free standing burster module include means for facilitating translational movement into relative cooperative adjacent alignment with the free standing inserter module.

6. The card insertion system of claim 1 in which at least two of the free standing inserter module, the free standing printer and the free standing burster include means for facilitating translational movement across a floor.

7. The card insertion system of claim 1 in which said free standing inserter module includes means for facilitating lateral alignment of the carrier inlet of the free standing inserter module with the printer outlet and the burster carrier form outlet.

8. A method of making a card insertion system, comprising the steps of interfacing an inserter module with a printer to enable printing of blank carrier forms on an on-line basis immediately prior to provision of the carrier forms to the inserter; and alternatively, interfacing the inserter module directly with a burster to enable provision of off-line preprinted carrier forms to the inserter module at a rate relatively more rapid than at which the printer can print carrier forms on-line.

* * * * *